US005540458A

United States Patent [19]

Arduin et al.

[11] Patent Number: 5,540,458

[45] Date of Patent: Jul. 30, 1996

[54] INTERFACE DEVICE BETWEEN A SKI AND BINDING ELEMENTS

[75] Inventors: Joël Arduin, Metz-Tessy; Vincent Dogat, Annecy, both of France

[73] Assignee: Salomon S.A., Metz-Tessy, France

[21] Appl. No.: 353,245

[22] Filed: Dec. 2, 1994

[30] Foreign Application Priority Data

Dec. 17, 1993 [FR] France ..... 93 15402

[51] Int. Cl.[6] ..... A63C 9/00

[52] U.S. Cl. ..... 280/602; 280/605; 280/634

[58] Field of Search ..... 280/601, 602, 280/607, 610, 611, 613, 617, 618, 634, 636, 11.14, 604, 605

[56] References Cited

U.S. PATENT DOCUMENTS

| | | | |
|---|---|---|---|
| 4,896,895 | 1/1990 | Bettosini | 280/607 |
| 5,135,250 | 8/1992 | Abondance et al. | 280/617 |
| 5,251,923 | 10/1993 | Stepanek et al. | 280/602 |
| 5,332,253 | 7/1994 | Couderc et al. | 280/602 |
| 5,360,229 | 1/1994 | Arduin et al. | 280/634 X |
| 5,397,149 | 3/1995 | Couderc et al. | 280/602 |

FOREIGN PATENT DOCUMENTS

| | | | |
|---|---|---|---|
| 0409749 | 1/1991 | European Pat. Off. . | |
| 0492658 | 7/1992 | European Pat. Off. . | |
| 0530449 | 3/1993 | European Pat. Off. . | |
| 0556610 | 8/1993 | European Pat. Off. . | |
| 0567780 | 11/1993 | European Pat. Off. . | |
| 2689775 | 10/1993 | France . | |
| WO83/03360 | 10/1983 | WIPO . | |
| 93/11838 | 6/1993 | WIPO | 280/634 |
| WO93/15797 | 8/1993 | WIPO . | |

*Primary Examiner*—Josie Ballato
*Attorney, Agent, or Firm*—Greenblum & Bernstein P.L.C.

[57] ABSTRACT

The invention relates to an interface device between a ski and element for retaining a boot on the ski. The device includes two stops intended to be connected to the ski toward the front and rear, respectively, of the central portion of the base of the ski, and a linking leg forming a stiffener between these two stops. The linking leg includes at least two levers, which are connected by at least one linkage forming a central pivotable connection. One of the bearing plates of the boot is vertically movable and transmits the vertical stresses from the boot to one of the levers, and an elastic restoring mechanism exerts an upward restoring force against one of the levers that is of sufficient intensity to keep the central pivotable connection of the two levers suspended when the boot is present. Preferably, the linkage between the levers is disengageable.

16 Claims, 8 Drawing Sheets

20
30
27
28
29
26
21
22
23
32
12
24
25
14
31

INTERFACE DEVICE BETWEEN A SKI AND BINDING ELEMENTS

BACKGROUND OF THE INVENTION

1. Field of the Invention

The present invention relates to an interface device that seeks to modify the natural distribution of a ski over the surface on which it slides.

2. Description of Background and Other Information

Skis used for alpine skiing are made up of relatively long beams on which the boots of the skier are retained by front and rear binding elements. The boots and the binding elements are located approximately in the middle zone of the ski.

In the resting position, a ski has a natural camber by which the middle zone is naturally raised relative to the front end of the ski, or tip, and the rear end of the ski, or heel. Furthermore, a ski has a flexibility which depends on its internal structure. During skiing, the ski is elastically deformed in response to the various stresses to which it is subjected by the skier, but also by the terrain on which it slides.

Interface devices exist that are interposed between the binding elements and the ski. Such interfaces are known, for example, from the patent publications such as International Patent Publication No. WO 83/03360, European Patent Publication No. 492,658 and European Patent Publication No. 409,749. These devices modify the flexibility of the beam of the ski by stiffening it or by having a damping effect. However, these devices act passively; that is, they react only to a predetermined flexion of the ski.

Another device of this type is known from French Patent Publication No. 2,689,775. The device disclosed therein includes a longitudinal beam raised relative to the ski. The rear end of the beam is solid with the ski, and its front end is joined by a block of shock absorbing material that undergoes shear stress. This device damps the flexing deformations of the ski. It also damps the boot vertically. However, damping is relatively rigid because of the rigid structure of the beam.

From European Patent Publication No. 530,449, in the name of the present applicant, an interface device is also known that dynamically modifies the distribution of pressure of the ski on the snow, as a function of the vertical stresses that the skier exerts on his or her skis. This device includes a vertically movable sensor that transmits the vertical stresses that it senses, originating in the boot, to the base of the front binding element. In one of the embodiments, the stresses are transmitted by way of a rocking or pivoting device and a substantially horizontal linkage plate is pivotally connected on one side to the rocking device and on the other to the base of the binding.

In an improvement made by the present applicant, the linkage plate is constructed like a toggle, which is closed by the boot and which opens on its own as soon as the boot is released.

Another improvement to this device consists of placing one or more prestressed springs between the rocking device and the base of the binding element, which springs absorb the excessive stresses that the sensor transmits to the base. By breaking, the toggle eliminates the reaction that the prestress induces in the ski as soon as the boot is released from its binding elements that retain it.

The attempt has been made to simplify the structure of this interface device, which is relatively complex, especially because of the presence of the rocker and its surroundings, by obtaining better vertical damping qualities than those of the device disclosed in French Patent Publication No. 2,689,775.

SUMMARY OF THE INVENTION

It is therefore an object of the present invention to provide an interface device that influences the distribution of pressure of the ski on the snow, and whose structure is simplified compared with existing devices.

Another object of the invention is to provide an interface device that has increased vertical and longitudinal damping characteristics when stresses are transmitted between the ski and the boot.

According to a first feature of the invention, the interface is constructed like a linking leg extending between two stops or abutments joined to the ski. The linking leg has at least two levers pivotally connected to one another, and the central linkage between the levers is kept suspended above the ski.

This mode of construction makes it possible to obtain dynamic characteristics of longitudinal stiffening of the ski and vertical damping of the boot, without resorting to a transmission of forces by means of a rocker or rocking device. The forces transmitted may, however, have increased intensity, since the linking leg is in the form of a kind of toggle pivotally connected in its central portion.

In accordance with another feature of the invention, a compressible element interposed between the ski and one of the levers of the linking leg exerts a vertical effort upward on the lever in question, in such a way as to keep the central pivotal connection suspended.

In addition, this compressible element locally transmits some of the vertical forces originating in the boot to the ski. This compressible element may also have damping or viscoelastic characteristics, and hence can contribute to the vertical damping of the boot. This damping is improved because the linking leg is constructed in the form of two pivotally connected levers.

In accordance with still another feature of the invention, the central linkage between the levers is disengageable, which makes it possible to render the interface inactive instantaneously. Advantageously, it is the brake actuation pedal of the ski that also controls this disengagement, so that the interface is only truly active when the boot is present.

According to another feature of the invention, the length of the linking leg is slightly greater than the distance between the two stops, so that the interface in repose exerts a prestress on the ski.

According to another feature of the invention, one of the support stops or abutments of the linking leg is movable in a longitudinal direction, and it is returned elastically toward the other stop. This advantageously makes it possible to limit the action of the interface on the ski when extremely strong stresses are exerted by the boot in the direction of the ski. This also makes it possible to limit the ascent toward the boot of deformations of the front part of the ski that are due to flexing of the ski, for example on a bump.

According to another feature of the invention, the rear lever is the slideway for the rear binding element. This makes it possible to make the rear end of the boot movable vertically to activate the interface, yet without stressing the opening mechanism of the grip.

According to another feature of the invention, the resting position of the central pivotable connection of the linking leg is adjusted relative to its two ends, so that a vertical force of the boot on the interface has a more or less pronounced effect on the distribution of pressure of the ski on the snow.

Other objects and advantages of the invention will become apparent from the ensuing description and from the accompanying drawings, which are an integral part of it, this description being given by way of illustrative and non-limiting example.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
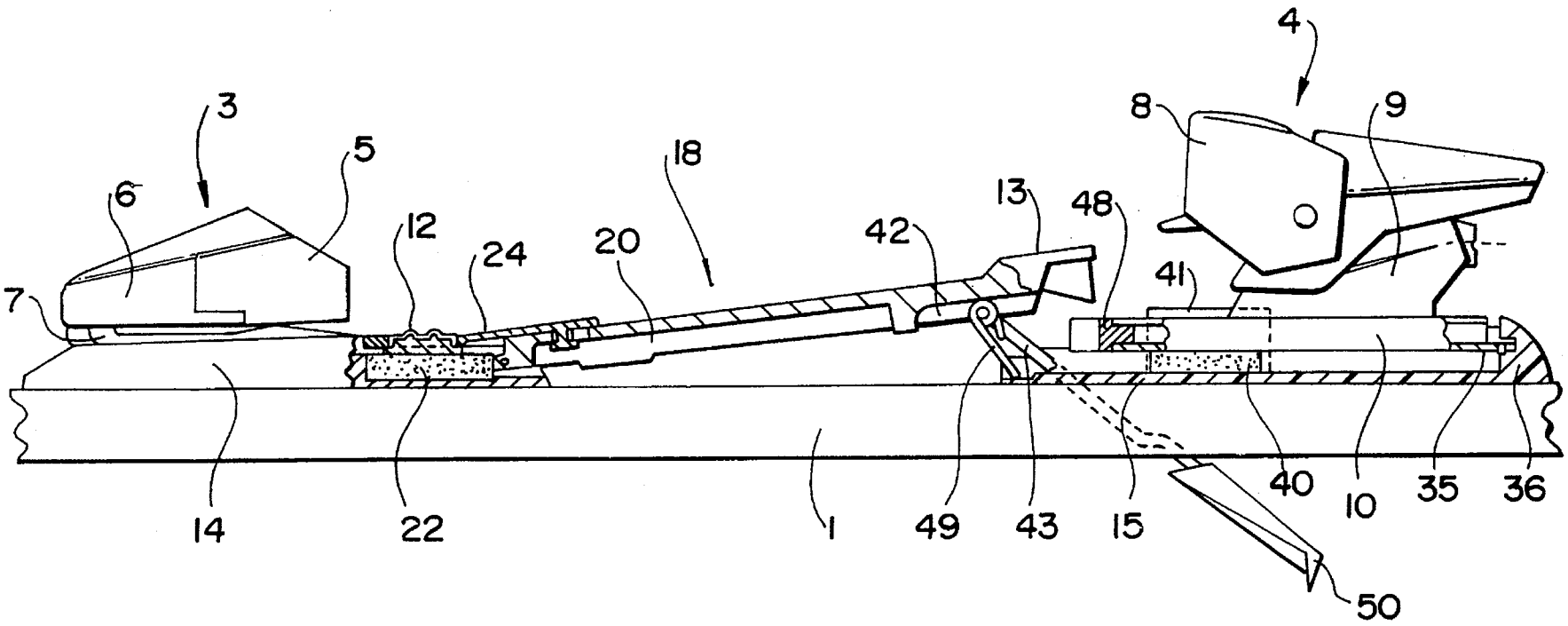
FIG. 1 is a side elevation view of a device in a first non-limiting embodiment of the invention.

FIG. 1 shows a ski 1, seen from the side, in its central zone. Binding elements 3 and 4 are mounted on the ski in this central zone.

The binding element 3 and 4 are of any suitable type. The front binding element 3, in a known manner, has a retaining jaw 5 for the front end of the boot. The jaw is carried by a body 6, and the body itself is mounted on a base plate 7 by which the binding element is attached to the ski.

In a similar way, the rear binding element 4 has a jaw 8 carried by a body 9. The body 9 is mounted to slide along a base plate 10 embodied as a slideway oriented longitudinally of ski, under the influence of a restoring spring that elastically presses the body frontward.

Also associated with each binding element 3, 4 is a respective support plate 12, 13, on which the heel of the boot rests, but these support plates will be described in greater detail later.

The interface device that is the subject of the present invention is located in the central zone of the ski.

It has a front stop and a rear stop which is solidly joined to the ski.

Advantageously, as the figures schematically show, the front abutment or stop 14 includes a base solidly joined to the ski by any suitable means, such as screws, and having on its upper surface a mounting zone intended to receive the base plate 7 of the front binding element.

similarly, the rear abutment or stop 15 is formed by a base that is solidly joined to the ski by any suitable means, such as screws. The base 15 extends under the base plate 10 of the rear binding element, and it is equipped with means to receive the base plate 10 of the rear binding element 4. These means will be described in greater detail later.

A pivotally connected linkage or linking leg 18 connects these two stops 14 and 15. The linking leg is held in a raised position relative to the upper surface of the ski.

In the example shown, the linking leg 18 includes two levers, a front lever and a rear lever, each connected to a respective front and rear stop. The two levers are intrinsically incompressible.

In reference to the drawing figures, the linking leg thus has a front lever 20 constituted by a sort of slender beam that is connected in its front portion to the front stop 14 by a link that enables pivoting of limited amplitude. FIG. 1 shows the front lever 20 in its upper position. In its lower position, schematically shown in FIG. 6, the front lever 20 is parallel to the upper surface of the ski, being raised relative to the upper surface of the ski.

The linkage between the lever 20 and the front base is of any suitable type, in particular by way of a transverse shaft, by cooperation with complementary shapes, or other means.

Figure 3:
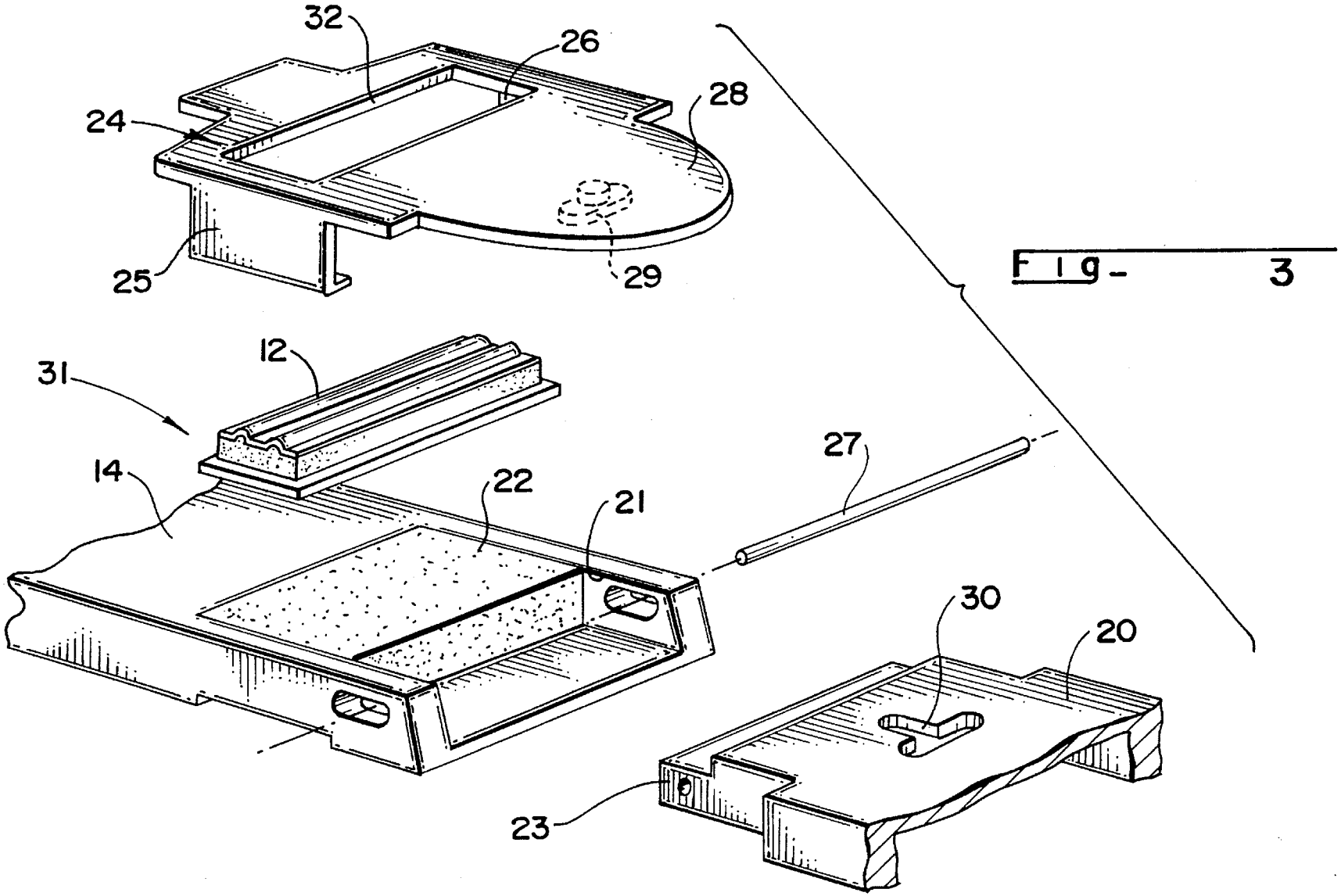
FIG. 3 is an exploded perspective view that illustrates the linkage between the front of the front lever and the ski.

FIG. 3 shows a preferred embodiment of this linkage. In this embodiment, the front stop 14, or in other words the base that carries the base plate of the binding element has a recess 21, open at the top and at the back, in its rear portion. A block 22 of elastically deformable material is lodged in this recess in such a way as to fill up at least the front portion of the recess. The block is of any suitable material and may have damping or viscoelastic properties.

The front end 23 of the lever 20 has a cross-section reduced to the dimensions of the recess 21, so that it can slide freely in the volume of the recess and if applicable compress the block 22. The front face of the end 23 is straightened to compress the block 22 by displacement toward the front relative to the base 14.

The linkage between the lever 20 and the base 14 is covered by a hood 24 made of an elastically deformable material. Advantageously, the hood 24 has two tabs 25 and 26 on its sides, which extend downwardly along the side faces of the base 14 and lock in undercuts of corresponding shape.

Toward the rear, the hood 24 has a tongue 28 that covers the front portion 23 of the lever 20.

The tongue has a plug or projection 29, toward its rear end, that cooperates with an opening 30, in the form of an oblong slot of the lever 20. The plug 29 can slide longitudinally in the oblong opening 30 over a limited amplitude. These means ensure that the lever 20 will become engaged to the base 14. Furthermore, the tongue reacts like a hinge and enables a rotary motion of the lever 20.

A transverse pin 27 optionally ensures the movable linkage between the lever 20 and the base 14.

Hence, the lever can pivot from an upper position to a lower position. Also, in the lower position of the lever, a relative motion between the base 14 and the lever 20 can ensue in a longitudinal direction. This movement compresses the block 22 which, as it deforms, opposes this motion.

The support plate 12 that supports the front end of the sole of the boot is preferably associated with the hood 24. For example, as FIG. 3 shows, the support plate 12 is the upper portion of a transverse bearing element 31 that rests on the base 14, on each side of the recess 21, and which traverses an opening 32 in the hood 24 in such a way that the support plate 12 projects above the hood 24.

Figure 4:
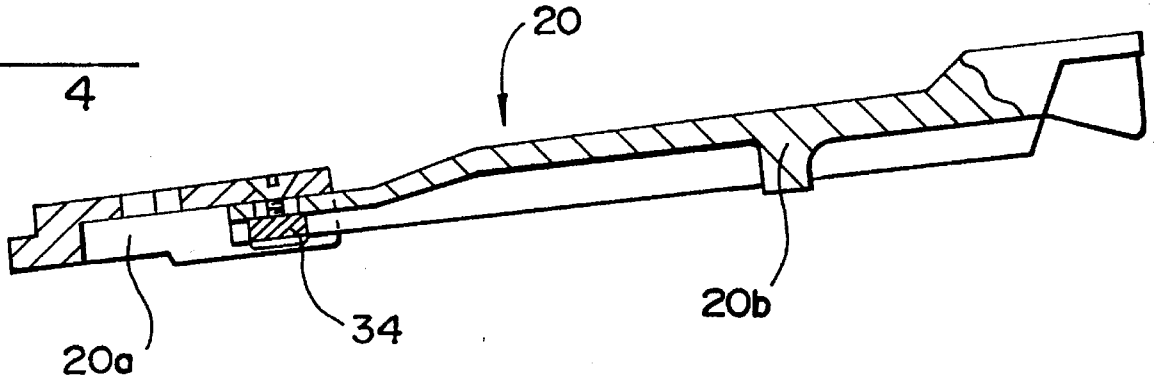
FIG. 4 is a side elevation view in section of the front lever, in a variant embodiment.

FIG. 4 shows a variant embodiment of the lever 20. In this variant, the lever is in two parts 20*a* and 20*b*, which are assembled by means that enable adjustment of the total length of the lever. For example, the ends of the parts 20*a* and 20*b* are provided so as to slide relative to one another in a longitudinal direction, and a holding bolt 34 passes through the arrangement at the level of an opening in the part 20*a* and a longitudinal slot in the part 20*b*.

Figure 2:
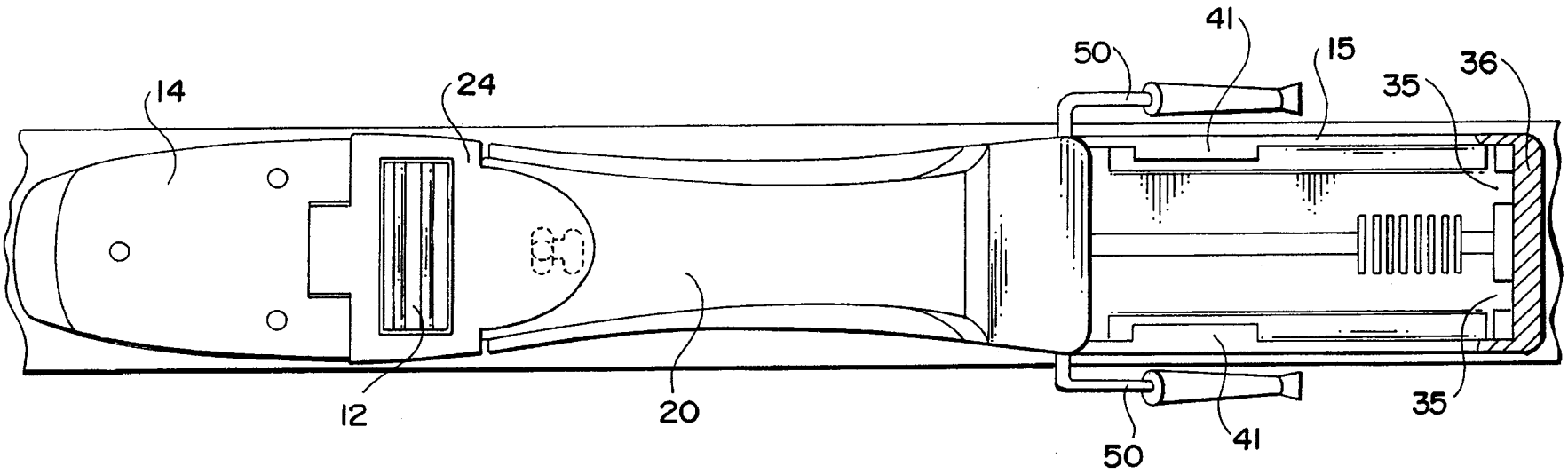
FIG. 2 is a top plan view of the device of FIG. 1, the binding elements not being visible in this figure.

The device of the invention also includes a rear lever that is journalled to the rear stop. In the embodiment shown, the rear lever is the base plate 10 which forms the slideway of the rear binding element 4. The base plate is connected to the base 15 in its rear portion by linkage means that ensure retention in a longitudinal direction and furthermore enable oscillation from top to bottom while impeding a rolling motion of the base plate relative to the base. In FIGS. 1 and 2, these means are shown in the form of two tabs 35, which form a rearward extension of the base plate 10 and which engage recesses of suitable dimension in the rear edge 36 of the base.

Naturally, any other suitable means may be employed, such as a transverse pivot shaft that connects the base plate and the footing. The fact that relative rolling motions between the base plate and the base are prevented is advantageous to ensure a good transmission of forces and lateral strains that pass between the ski and the boot.

The base plate 10 is also kept raised relative to the upper surface of the ski, or more precisely with respect to the base 15, by an elastic restoring means 40, which develops an upward restoring moment on this element of sufficient intensity to keep the base plate 10 in the suspended state when the boot is present, and preferably even in the case where downward stresses are exerted by the boot on its bearings.

This elastic restoring means connects the base plate and the ski, for example by way of the base 15. It ensures damping of the stresses that transmitted by the boot. Furthermore, it localizes the zone of the ski that is stressed for the reaction to a stress by the elastic restoring means. Hence, it has influence on the distribution of pressure of the ski on the snow.

In the embodiment shown, the elastic restoring means is a block 40 of elastically compressible material, which has damping and preferably viscoelastic properties. The block 40 is located forward of the base plate 10, between the base and the base plate. It concentrates the vertical forces that the boot transmits to the ski into this zone.

Any other elastic restoring means may be suitable, such as a compression spring or a torsion spring.

Preferably, the base plate is retained at the top by a stop. In the drawings, this stop is embodied by lateral tabs 41 of the base 15, which rise on each side of the base plate 10 and have an inwardly directed bent portion.

The two levers 20 and 10 that form the force leg are also connected on their adjacent end by a linkage. This linkage ensures a longitudinal transmission of forces from one lever to the other, when these levers are approximately aligned. The linkage also enables a relative angular motion of reduced amplitude between the two levers.

Preferably, when the two levers are substantially in longitudinal alignment with one another, the length of the linking leg thus formed is slightly greater than the space provided between the two stops. This induces a prestress in the linking leg, part of which is absorbed by the compression of the block 22. Also preferably, the linkage between the two levers is disengageable, and the interlocking or disengagement of the linkage is automatic with the engagement or disengagement of the boot, so that this prestress vanishes in the absence of the boot.

In the embodiment shown in FIG. 1, the front lever 20, which is pivotally connected at the front by an elastic hinge, has a rear end that can nest in the front end of the lever 10 and come unnested from it.

The rear end of the lever 20 is urged upward by an elastic restoring means, in the present case a retractable lifting arm 43.

The front lever 20 also, toward its rear end, has the support plate 13 on which the rear end of the boot heel rests.

Figure 5:
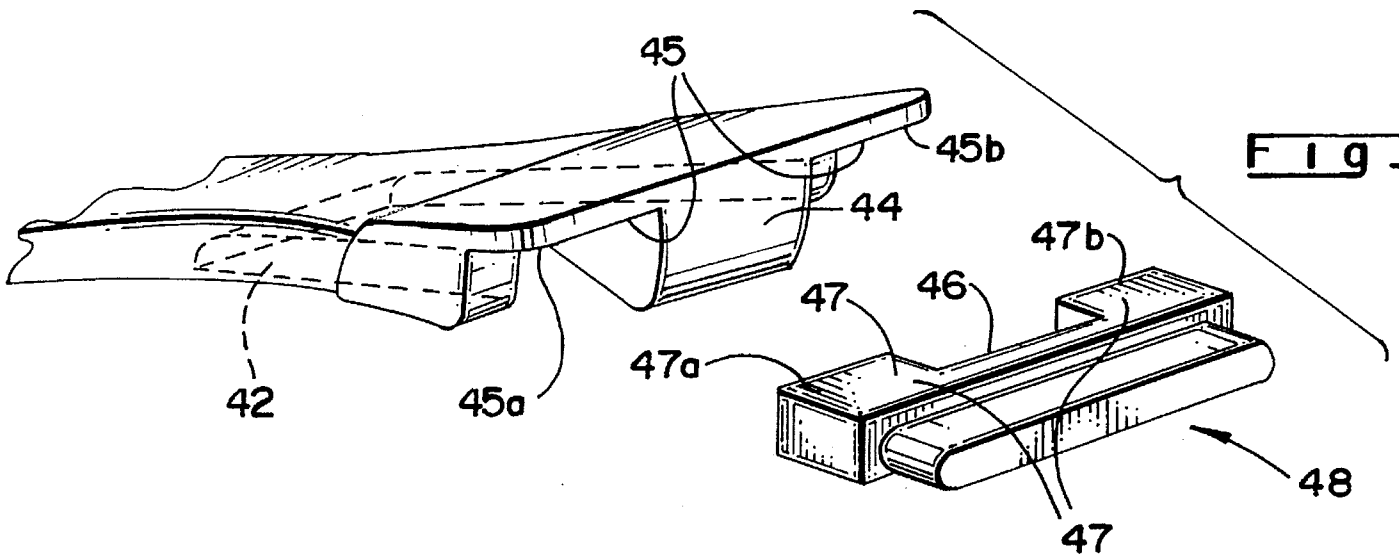
FIG. 5 is a fragmentary perspective view of the device of FIG. 1, more particularly illustrating the linkage between the two levers.

The interlocking or nesting means are shown more particularly in FIG. 5. For the rear end of the lever 20, they include two substantially perpendicular bearing faces 44 and 45. Toward the lever 10, the interlocking means include complementary bearing faces 46 and 47. These bearing faces preferably constitute the front end of a linkage piece 48, whose rear end engages the profile section of the slide that forms the lever 10.

The faces 44 and 46 are intended to transmit the longitudinal forces between the two levers. When the levers are interlocked or nested, the faces 44 and 46 are substantially vertical. One of the faces is preferably slightly bulging or beveled, in such a way as to provide a taking of play and compression stress at the time of the interlocking.

The faces 45 and 47 cover one another mutually and ensure the vertical transmission of the stresses to which the support plate 13 is subjected. In FIG. 5, these faces are in two parts, 45*a* and 45*b* on the one hand and 47*a*, 47*b* on the other, situated on either side of the surfaces 44 and 46.

The lifting arm 43 is carried by the front portion of the base 15. It is pivotally connected to this base about a transverse shaft, and its upper portion rotates in a receptacle 42 located on the lower face of the lever 20. A spring 49 moreover assures the elastic lifting of the arm 43.

Advantageously, the arm 43 constitutes the actuating device of a ski brake. As can be seen in the drawings, the arm 43 is extended rearward by two brake spades 50, which pass on either side of the ski.

The spring 49 is also the restoring spring of the ski brake thus formed in its active braking position.

Figure 6:
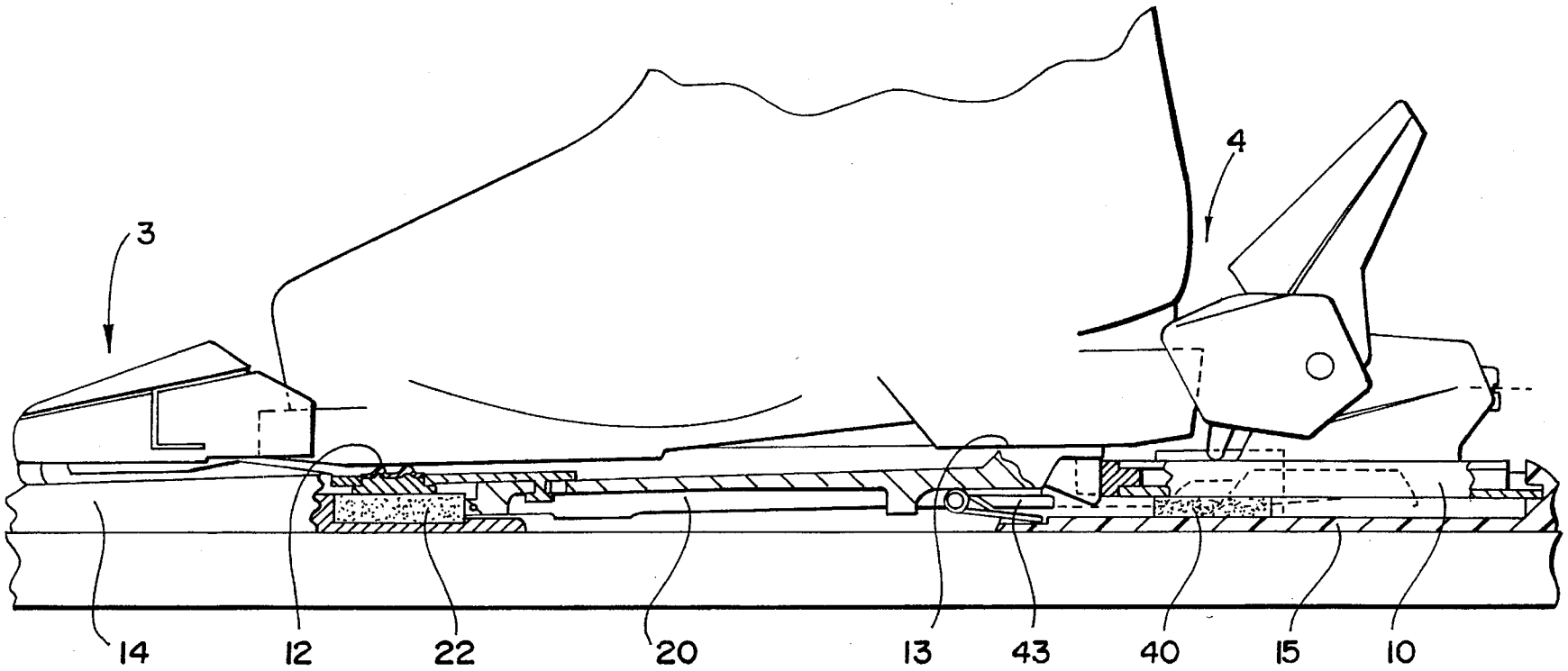
FIG. 6 is a side elevation view of the device of FIG. 1 in the presence of the boot and in the resting position.

The function of the device is as follows. Beginning at the resting position shown in FIG. 1, engagement of the boot in the binding element causes the heel to be supported on the support plate 13. The lever 20 moves downward, and in moving downward it causes the retraction of the arm 43 and the reentry of the brake spades 50, against the restoring force of the spring 49. The lever 20 moves downward until it nests with the rear lever 10. The linking leg is thus formed between the two stops or bases 14 and 15. This nominal configuration of the device is shown in FIG. 6. The pivotable connection of the linking leg is kept suspended by the action of block 40, which is compressed only slightly, only under the influence of the weight of the skier.

It must be stressed that preferably, the linking leg has slightly compressed the compressible block 22 located toward the front.

Figure 7:
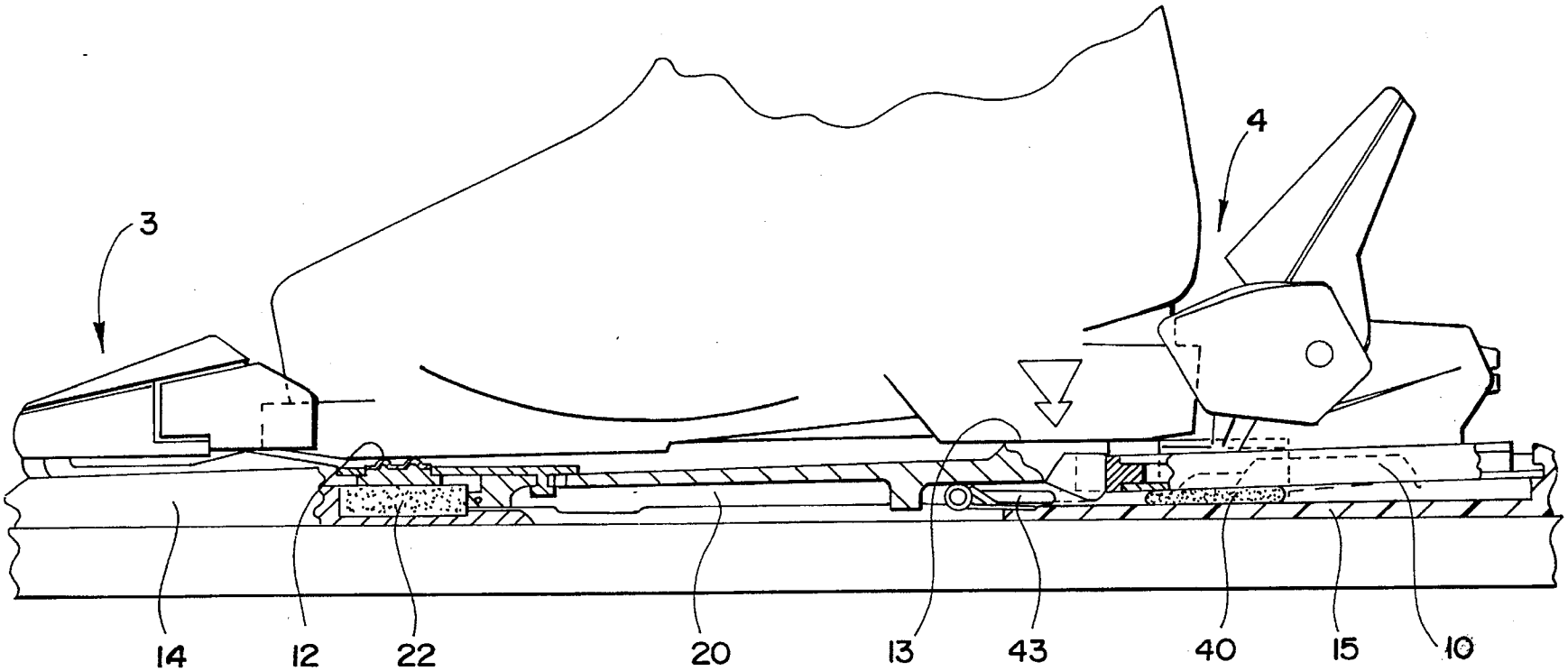
FIG. 7 is a side elevation view of the device of FIG. 1, in the presence of the boot and under the influence of a vertical downward stress.

During skiing, the skier transmits vertical stresses downward to the support plate 13. These stresses are diffused in the two levers and thus cause the elastic compression of the block 40, with an effect of elastic suspension. The block 40 transmits the vertical stresses from the boot to the ski. FIG. 7 illustrates this kind of stress by the boot on the linking leg 18.

During skiing, the linking leg thus acts like a longitudinal stiffener of the ski. The front block 22 acts as a damper or shock absorber of this stiffener. In particular, it damps the flexions of the ski that are caused by the contours of the terrain the ski encounters. It thus prevents such ski flexions from rising integrally to the linking leg and to the boot.

In addition, depending on the relative length of the levers with respect to the distance between the two bases, and depending on the relative height of the linkage between the two levers with respect to the linkage of the levers to the bases, the linking leg 18 may have a more or less pronounced longitudinal action on the two bases.

For example, if in the nominal position i.e., in the presence of the boot but without other external influences, the central linkage is markedly raised relative to the linkages of the levers to the bases, then lowering the linkage during skiing, i.e., in an active position of the central linkage, produces a longitudinal extension of the linking leg. Since the linkages between the levers and the bases are raised relative to the upper surface of the ski and hence relative to its neutral fiber, extending the force leg induces a flexion moment toward the front of the ski and rearward, which tends to cause the ends of the ski to drop toward the snow. The effect of extending the linking leg is absorbed in part by the compression of the front block 22.

If in the nominal position the central linkage is located substantially at the height of the linkages between the levers and the bases, then lowering the central linkage does not substantially exert any longitudinal force on the bases.

The front block 22, however, continues to play the role of a shock absorber in the case of ski flexion.

The central linkage can also, in the nominal position, be below the level of the linkages between the levers and the bases.

When the boot accidentally or intentionally leaves the binding elements, the arm 43 releases the lever 20 and drives it upward. In parallel, the brake spades move downward to an active braking position.

Figure 8:
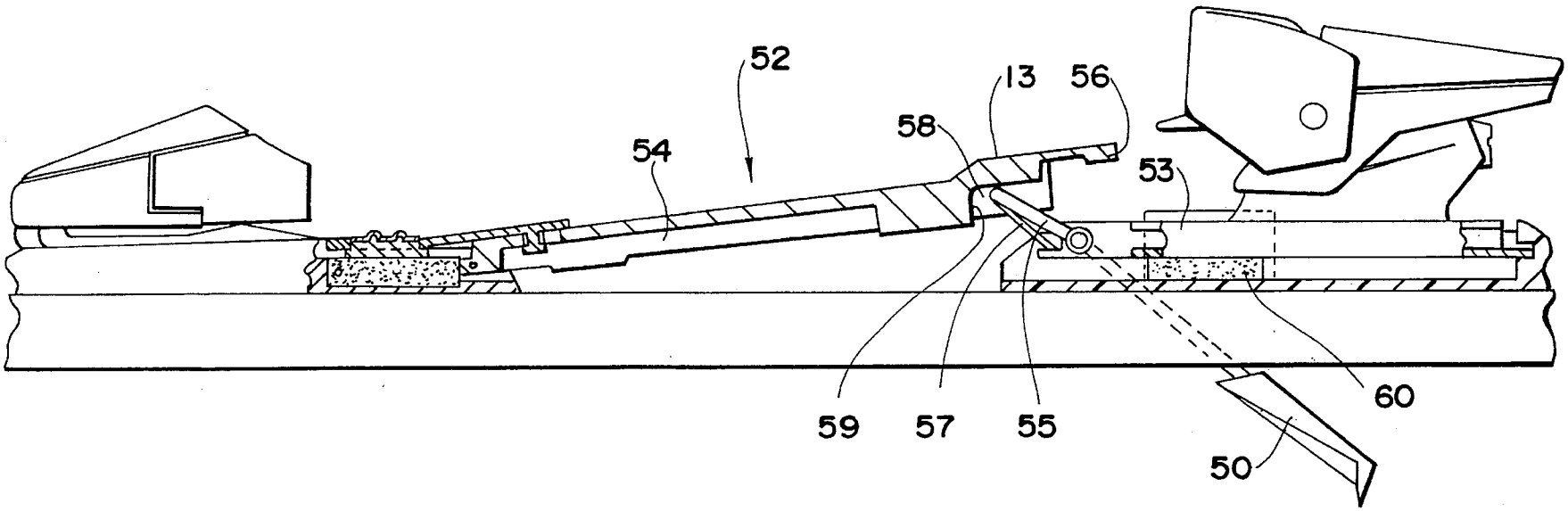
FIG. 8 is a side elevation view of an interface device in a variant embodiment of the invention.
Figure 9:
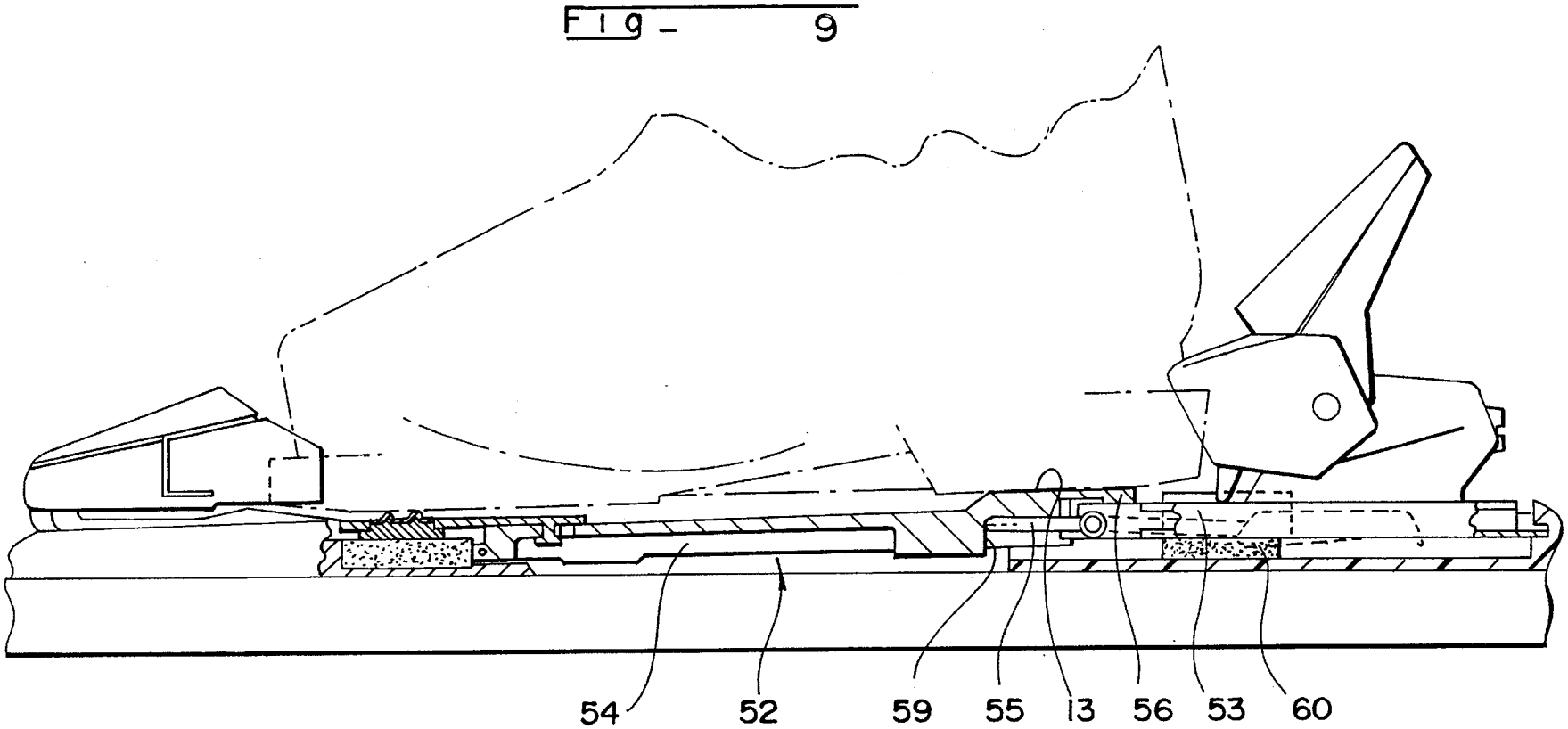
FIG. 9 is a view similar to FIG. 8 of the device, in the presence of the boot.

FIGS. 8 and 9 illustrate a variant embodiment.

In this variant, the linking leg 52 includes a rear lever 53, a front lever 54, and an intermediate lever 55 that assures a complex central pivotable connection of the linking leg.

The rear lever 53 is of the same type as the foregoing lever 10. The front lever 54 is also of the same type as the foregoing lever 20, except that its rear end is longer and ends in an extension 56 that can rest directly on the front end of the lever 53, in a vertical direction.

The intermediate lever 55 is joined at its base to the rear lever 53, about a transverse shaft. It is returned elastically upward by a spring 57. Its front part slides in a recess 58 that the front lever has on its lower face, thereby constituting respective longitudinally confronting surfaces. The recess 58, in its front portion, has a vertical bearing face 59, against which the intermediate lever rests in a longitudinal direction, as shown in FIG. 9, when the boot is present.

Advantageously, the lever 55 is extended rearward by two brake spades, in such a way as to form a braking device for the ski.

An elastically deformable block 60 is located between the rear lever 53 and the ski. This block performs the same function as the foregoing block 40. Similarly, the linkage between the front lever and the front binding element is of the same type as in the foregoing embodiment.

In a vertical direction, the stresses of the boot are picked up by the support plate 13 located to the rear of the lever 54 and are transmitted to the rear lever 53. The block 60 assures an elastic suspension of the linking leg.

In a longitudinal direction, the stresses pass between the two front and rear levers, via the intermediate lever. This additional element allows a slight deformation of the linking leg in the course of its vertical suspension motions. In addition, the entire linking leg, including the brake, is suspended. Only the block 60, under the heel of the boot, ensures the transmission of vertical forces between the boot and the ski. It appears that this construction improves the suspension effect by lending it the advantage of flexibility.

Finally, although the invention has been described with reference of particular means, materials and embodiments, it is to be understood that the invention is not limited to the particulars disclosed and extends to all equivalents within the scope of the claims.

What is claimed is:

1. An interface device between an alpine ski and a ski boot for modifying the pressure distribution of the ski along a sliding surface of the ski, the ski being equipped with a front binding element and a rear binding element adapted to retain the boot in a central portion of the ski, each of the binding elements having a base plate connected to the ski and at least one bearing plate for supporting one end of a sole of the boot, said interface device comprising:

a front stop and a rear stop adapted to be connected solidly to respective ends of the central portion of the ski;

a linking leg forming a stiffener between said front stop and said rear stop;

a front pivot connection between a front end of said linking leg said front stop and a rear pivot connection between a rear end of said linking leg and said rear stop, said front pivot connection and said rear pivot connection adapted to be raised with respect to an upper surface of the ski;

said linking leg comprising at least a front lever and a rear lever raised with respect to the upper surface of the ski and at least one central pivot connection between said front lever and said rear lever for transmitting longitudinal forces between said front lever and said rear lever and for enabling movement of said linking leg between a raised position and a lowered position, said front lever and said rear lever being substantially longitudinally coextensive in said lowered position of said linking leg; and an elastic restoring device coupled to one of said front lever and rear lever for exerting an upward restoring force of sufficient intensity for maintaining said central pivot connection raised from the upper ski surface in said lowered position during application of a downward force exerted by the boot.

2. An interface device according to claim 1 in combination with said front binding element and said rear binding element, wherein:

one of said bearing plates for the sole of the boot is a movable bearing plate solidly affixed to one of said front lever and said rear lever in an area of said central pivot connection.

3. An interface device according to claim 2, wherein:

said elastic restoring device comprises an element made of elastically compressible material, said element being positioned beneath one of said front lever and said rear lever and adapted to be positioned above the upper surface of the ski for exerting an upward force against said one of said front lever and said rear lever and a downward force against the upper surface of the ski, said element being positioned in the vicinity of said movable bearing plate.

4. An interface device according to claim 3, wherein:

said elastic restoring device is an elastically deformable block of shock-absorbing material.

5. An interface device according to claim 1, wherein:

said central pivot connection between said front lever and said rear lever is disengageable.

6. An interface device according to claim 5, further comprising:

an auxiliary restoring device for exerting an upwardly directed elastic restoring moment upon one of said front lever and said rear lever, said one of said front lever and said rear lever constituting a movable lever.

7. An interface device according to claim 6, wherein:

said auxiliary restoring device comprises a lifting arm and a restoring spring, said restoring spring being positioned for applying a restoring force to said lifting arm for exerting a force to said movable lever.

8. An interface device according to claim 7, wherein:

said lifting arm further comprises a base portion about which said lifting arm is pivotally mounted, said lifting arm extending beyond said pivotal mounting by a pair of spades, said pair of spades being spaced apart a distance greater than a width of the ski, said pair of spades constituting braking spades for the ski.

9. An interface device according to claim 6, wherein:

said front lever has a rearward portion with a vertical face and a horizontal face;

said rear lever has a forward portion with a vertical face and a horizontal face for engagement with said vertical face and said horizontal face, respectively, of said front lever.

10. An interface device according to claim 6, wherein:

said linking leg further comprises an intermediate lever;

said rear lever and said intermediate lever are connected by means of a pivotable connection about a transverse shaft;

said front lever and said intermediate lever are connected longitudinally by means of respective confronting surfaces; and said front lever comprises an extension extending rearwardly beyond said respective confronting surfaces over said intermediate lever, said extension being supported upon a front end portion of said rear lever, said extension comprising a support for a rear portion of the boot.

11. An interface device according to claim 1, further comprising:

an elastically deformable device longitudinally interposed between one of (1) said front lever and said rear lever and (2) said front stop and said rear stop.

12. An interface device according to claim 11, wherein:

said linking leg has a maximum length substantially greater than a distance between said front stop and said rear stop for generating a compressive stress in said linking leg.

13. An interface device according to claim 11, wherein:

said elastically deformable device is a block of compressible material pressing against one of said front stop and said rear stop, when solidly connected to the ski, and stressed with compression by one of said front lever and said rear lever.

14. An interface device according to claim 1, wherein:

said rear lever is a base plate supporting the rear binding element, said rear base plate being pivotally connected to said rear stop about an axis raised with respect to the upper surface of the ski.

15. An interface device according to claim 1, wherein:

in the presence of the boot in a nominal position of the linking leg, said central pivot connection is positioned above an alignment of said front pivot connection and said rear pivot connection.

16. An interface device according to claim 1, wherein:

in the presence of the boot in a resting position of the linking leg, said central pivot connection is positioned at a level of alignment of said front pivot connection and said rear pivot connection.

* * * * *